United States Patent [19]

Palma et al.

[11] 4,405,912

[45] Sep. 20, 1983

[54] SOLENOID ASSEMBLY AND METHOD OF MAKING SAME

[75] Inventors: James D. Palma, Grand Rapids; Michael J. Seino, Wyoming, both of Mich.

[73] Assignee: General Motors Corporation, Detroit, Mich.

[21] Appl. No.: 343,431

[22] Filed: Jan. 28, 1982

[51] Int. Cl.[3] ..... H01F 7/08; H01F 3/00

[52] U.S. Cl. ..... 335/260; 335/278

[58] Field of Search ..... 335/260, 278

[56] References Cited

U.S. PATENT DOCUMENTS 3,598,360 8/1971 Merriner et al. ..... 335/260

*Primary Examiner*—Harold Broome

*Attorney, Agent, or Firm*—Arthur N. Krein

[57] ABSTRACT

A solenoid assembly, as for use in an electromagnetic fuel injector or similar valve assembly, and a method of making the same wherein a cylindrical pole piece is positioned in and fixed at one end to an apertured, cup-shaped solenoid housing so as to initially support and center a bobbin and solenoid coil assembly which is then secured in fluid tight relationship to the solenoid housing by an encircling encapsulant member molded in place.

2 Claims, 5 Drawing Figures

SOLENOID ASSEMBLY AND METHOD OF MAKING SAME

This invention relates to solenoid assemblies and, in particular to solenoid assemblies for use in electromagnetic fuel injectors of the type used in gasoline engines and, to the method of making such solenoid assemblies.

DESCRIPTION OF THE PRIOR ART

The use of electromagnetic fuel injectors in fuel injection systems for vehicle gasoline engines has increased in recent years because of the capability of this type injector to inject a precise metered quantity of fuel per unit of time.

In such known injectors, it has been common practice to utilize mechanical seals, such as elastomeric O-rings, to prevent the flow of fuel from the injector. As well known, such O-rings are used to effect a seal between various components of the injector which may be made of dissimilar materials and, accordingly, have different rates of expansion or contraction, as a function of temperature variations. In view of this fact and the fact that such O-rings tend to become less flexible at colder temperatures, great care must be exercised relative to the appropriate location of such seals in the injector. In addition, in the assembly of such seals in the injector care must be exercised so that such a seal is not damaged during the installation thereof in the injector.

SUMMARY OF THE INVENTION

The present invention relates to an improved solenoid assembly for use in an electromagnetic fuel injector or other similar valve assembly and, to a method of making the same, the solenoid assembly is so constructed that the pole piece and the bobbin/solenoid coil are encapsulated to the solenoid housing in fluid tight relationship thereto.

It is therefore a primary object of this invention to provide an improved solenoid assembly having a cylindrical pole piece positioned within and fixed at one end to a solenoid housing provided with plural apertures therethrough and having a solenoid coil wound on a spool bobbin that is supported at one end by the pole piece and an encapsulating material encapsulating the pole piece and the solenoid coil/bobbin assembly and the solenoid housing into a unit assembly.

Another object of this invention is to provide an improved solenoid assembly wherein a pole piece and a solenoid coil/bobbin assembly are secured in fluid tight relationship to and within an apertured, cup-shaped solenoid housing.

Another object of this invention is to provide a method for making a solenoid assembly wherein a cylindrical pole piece is fixed at one end to an apertured, cup-shaped solenoid housing; a solenoid coil and bobbin then being inserted uncoated through the open end of the solenoid housing so as to be supported at one end by the pole piece; positioning this assembly into a multipiece mold; and then injection molding an encapsulating material into and around the solenoid housing whereby to secure the solenoid coil/bobbin and pole piece in fluid tight relationship to the solenoid housing.

For a better understanding of the invention, as well as other objects and features thereof, reference is had to the following detailed description of the invention to be read in connection with the accompanying drawings.

DESCRIPTION OF THE EMBODIMENTS

Figure 1:
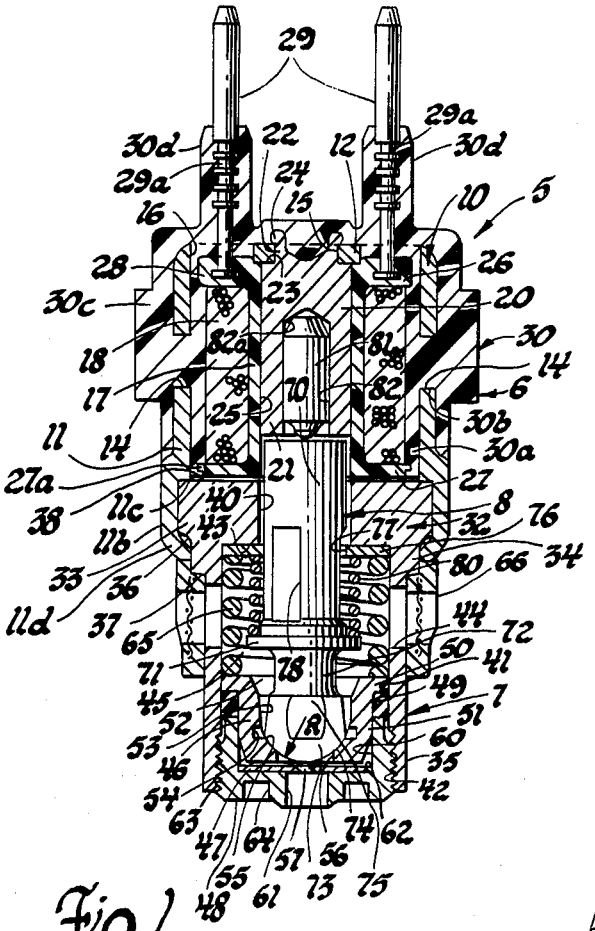
FIG. 1 is a longitudinal cross-sectional view of an exemplary embodiment of an electromagnetic fuel injector having a solenoid assembly in accordance with the invention incorporated therein, the pole stop member and armature/valve member of the injector being shown in elevation.

Referring first to FIG. 1, the embodiment of the electromagnetic fuel injector, generally designated 5, illustrated therein includes, as major components thereof, a solenoid assembly 6, a nozzle assembly 7 and an armature/valve member 8.

The solenoid assembly 6 includes a cup-shaped, solenoid housing 10, made for example of SAE 1008–1010 steel, having a rim like, circular body 11 and an integral flange 12 extending radially inward from the upper end of body portion 11. Body 11 is provided with a plurality of circumferentially spaced apart apertures 14 located intermediate its ends. As shown, body portion 11 includes an upper portion **11*a* and a lower portion 11*b*, having both a greater internal diameter and a greater external diameter than the respective diameters of upper portion 11*a*, and an inter-internal flat shoulder 11*c***.

The flange 12 is provided with a central aperture 15 and with plural apertures 16, only two such apertures being seen in FIG. 1, that are circumferentially equally spaced apart and located radially outward, a predetermined distance, from the central aperture 15, all for a purpose to be described hereinafter. Preferably, at least two diametrically opposite apertures 16 are of arcuate configuration for a purpose also to be described in detail hereinafter.

Solenoid assembly 6 further includes a cylindrical pole piece 20 and a spool-like, tubular bobbin 17 supporting a wound wire solenoid coil 18. In the construction illustrated, pole piece 20 is provided with a cylindrical lower portion 21 of predetermined diameter, a cylindrical upper portion 22 of a reduced diameter corresponding to the internal diameter of aperture 15 and an interconnecting flat shoulder 23.

The pole piece 20 is fixed to the solenoid housing as by having the portion 22 of the pole piece 20 extending through the aperture 15, with the upper blind bored end of portion 22 crimped or swaged over so as to define a retention flange 24 whereby the material of the flange portion 12 of the solenoid housing 10 adjacent to aperture 15 is sandwiched between the shoulder 23 and the retention flange 24.

The bobbin 17, made, for example, of a suitable plastic material such as glass filled nylon, is provided with a central through bore 25 of a diameter to receive the lower portion 21 of pole piece 20, as by a press fit engagement therewith, whereby the bobbin 17 is supported concentrically within the solenoid housing 10 and with the upper flange 26 thereof in abutment against the inside surface of the flange portion 12 of the solenoid housing 10.

Figure 5:
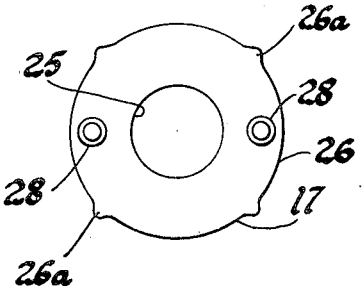

In the construction shown, both the upper flange 26 and bottom flange 27 of bobbin 17 are of similar external configuration and, as best seen in FIG. 5, each includes a main flange portion having at least three or more circumferentially spaced apart, radially outward extending lobes such as lobes 26*a* on flange 26, formed integral therewith. Preferably, the major diameter of each flange, as defined by the outer peripheral edges of the lobes is selected relative to the inside diameter of the wall 11*a* of the solenoid housing 10 whereby the bobbin will be slidably received in this portion of the solenoid housing.

The minor diameter of each of the flanges 26 and 27, as defined by the outer peripheral edge of the main flange portion of each such flange is such so as to provide for radial clearance between it and the interior of wall 11*a* of the solenoid housing 10 for the passage of the encapsulant material of the encapsulant member 30 to be described hereinafter. Preferably, as shown with reference to FIG. 1, for example, the minor diameter of the flanges, and in particular of the upper flange 26 and the radial location of the apertures 16 are preselected to allow for the passage of encapsulant material around the outer peripheral edge of the main flange portion of upper flange 26 and through the apertures 16 for a purpose to be described hereinafter.

Bobbin 17 is also provided with a pair of diametrically opposed upright terminal leads 29, which project upward from bobbin flange 26 and from the opposed upstanding bosses 28 thereon so as to project centrally up through the apertures 16 of corresponding arcuate shape in the solenoid housing 10 for connection to a suitable controlled source of electrical power, as desired. The opposite end of each such lead 29 is suitably connected, in a known manner, to a terminal end of the solenoid coil 18. Preferably, as shown in FIG. 1, each terminal lead 29 is provided at its upper enlarged diameter end, with a plurality of axial spaced apart annular grooves 29*a* for a purpose to be described in detail hereinafter.

Preferably, the axial extent of bobbin 17 is preselected relative to the internal axial extend of the body 11 portion of the solenoid housing between the lower surface of flange 12 and the shoulder 11*c* so that when the bobbin 17 is positioned in the solenoid housing 10, as shown in the Figures, an axial clearance will exist between the lower face of the bottom flange 27 of the bobbin 17 and the shoulder 11*c* of the solenoid housing 10, for a purpose to be described hereinafter.

Bobbin 17 is further supported within the solenoid housing 10 by means of an encapsulant member 30, made of a suitable encapsulant material, such as glass filled nylon, that includes a cylindrical portion 30*a* encircling the solenoid coil 18 and the outer peripheral edge of the lower flange 27 of the bobbin 17 and which is also in abutment against the inner surface of the upper portion 11*a* of body 11, a plurality of radial or axial extending bridge connectors 30*b* corresponding in number to the apertures 14 and 16, respectively, an outer cup-shaped outer shell 30*c* encircling the exterior upper portion 11*a* of body 11 and flange 12 of the solenoid body 10 and a pair of diametrically opposed studs 30*d*, each of which encloses a terminal lead 29. It will now be apparent that the bridge connectors 30*b* extending through apertures 14 and 16 and the material adjacent the lower ends of studs 30*d*, extending through associate apertures 16, serve to interconnect the portion 30*a* and shell 30*c* to each other. As shown, the encapsulant material of studs 30*d* extends into each of the annular grooves 29*a* of a terminal lead 29 to make it more securely fixed to the assembly.

Figure 2:
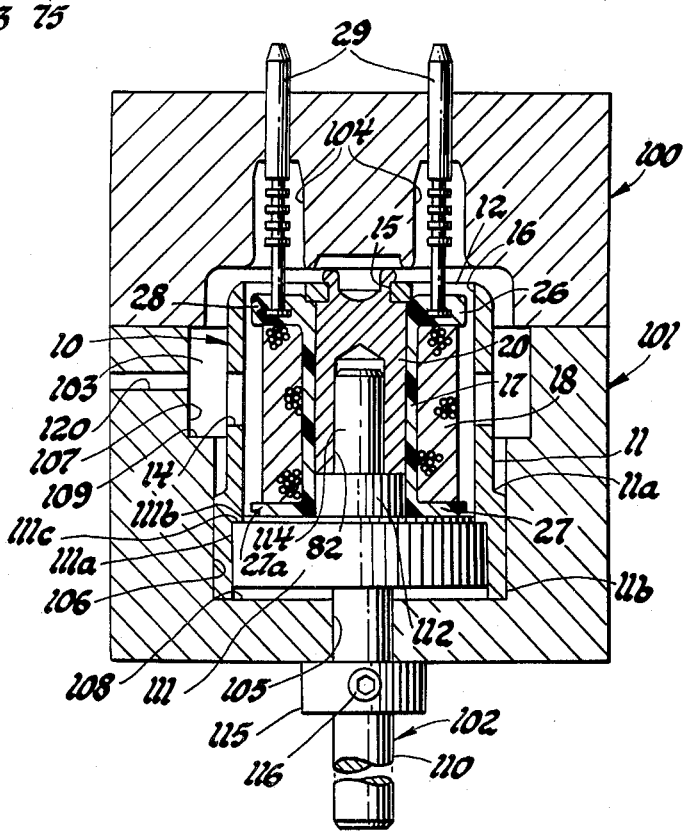
FIG. 2 is a longitudinal cross-section view of the solenoid assembly, per se, of FIG. 1 mounted in a multipiece mold, shown schematically, of the type used for the injection molding of an encapsulating material into and around a portion of the solenoid housing thereof.

Preferably, as shown in FIGS. 1 and 2, the flange 27 of bobbin 17 is undercut at its lower outer peripheral edge to effect a lock with the cylindrical portion 30*a* of the encapsulant member 30 so as to further effect positive retention of the bobbin 17 within the solenoid housing 10.

In a manner to be described in detail hereinafter, the encapsulant member 30 is molded in place whereby a fluid tight seal exists between the above described elements of the solenoid assembly.

The nozzle assembly 7 includes a nozzle body 32 of tubular configuration, having a circular upper portion 33, a circular intermediate portion 34 and a circular lower portion 35. Portions 34 and 35 are of successively reduced external diameters relative to the external diameter of upper portion 33. Portions 33 and 34 are interconnected by an external shoulder 36 and portions 34 and 35 are interconnected by an external shoulder 37.

The nozzle body 32 is fixed to the solenoid housing 10, with the outer edge portion of the flat upper surface 38 of the nozzle body 32 in abutment against shoulder 11*c*, as by inwardly crimping or swaging the lower end of body portion 11*b* at a location next adjacent to shoulder 36 to define a radially inward extending rim flange 11*d*. Since as previously described, the axial extent of bobbin 17 is preselected to provide an axial clearance between its lower surface and the shoulder 11*c*, the nozzle body 32 will abut against this shoulder. In addition, because of the increased rate of thermal expansion of the material of the bobbin relative to the material of the solenoid housing 10, a sufficient clearance is provided for this expansion so that the bobbin will not press against the nozzle body 32.

Nozzle body 32 is provided with a central through stepped bore to provide an internal circular upper wall 40 and a lower wall 41, which is of a greater internal diameter than that of wall 40 and which is provided at its lower end with internal threads 42. The walls 40 and 41 are interconnected by a flat shoulder 43.

In addition, the nozzle body 32 is provided with a plurality of circumferentially spaced apart radial ports 44 in the lower portion 35 which open into a fuel chamber 45 defined in part by the lower wall 41.

The nozzle assembly 7 further includes a valve seat element 46, a director plate 47 and a spray tip 48 with a seal ring 49 positioned between the valve seat element 46 and spray tip 48 in a manner to be described hereinafter.

Valve seat element 46 is provided with a flange 50 and with a reduced diameter body 51 depending therefrom, which is preferably tapered at its oower end, as shown, to effect its assembly into spray tip 48. A stepped central bore through the valve seat element 46 defines, in succession, starting from the top with reference to FIG. 1, an internal conical upper wall 52, an internal straight guide wall 53, an annular recess 54, a conical valve seat 55 and a lower wall defining a discharge passage 56.

The director plate 47 is provided with a plurality of circumferentially, equally spaced apart inclined and axial extending director passages 57. Preferably six such passages are used, although only one such passage is shown in FIG. 1. These director passages 57, of predetermined equal diameters, extend at one end downward from the upward surface of the director plate 47 and are positioned so as to be located radially inward of the discharge passage 56 and the valve seat element 46.

The spray tip 48, of cup-shaped configuration, is provided with a circular internal upper wall 60 and a reduced diameter lower wall 61 that defines a passage for the discharge of fuel from the nozzle assembly. The walls 60 and 61 are interconnected by a flat shoulder 62.

As illustrated, the upper wall 61 of the spray tip 48 is of a suitable internal diameter whereby to slidably receive the wall portion 51 of the valve seat element 46 and to receive the director plate 47 so as to be sandwiched between the lower end surface of the valve seat element 46 and the internal shoulder 62 of the spray tip. As shown, the ring seal 49 is located so as to encircle the reduced diameter body 51 of the valve seat element 46 whereby it will be sandwiched between the valve seat element 46 and the internal wall 41 of the nozzle body 32.

In the construction shown, the outer peripheral surface of the spray tip 48 is provided with external threads 63 for mating engagement with the internal threads 42 of the nozzle body 32. Preferably these mating threads are of a suitable fine pitch whereby to limit axial movement of the spray tip a predetermined extent, as desired, for each full revolution of the spray tip 48 relative to the nozzle body 32.

The lower face of the spray tip 48 is provided, for example, with at least a pair of diametrically opposed blind bores 64 of a size so as to slidably receive the lug of a suitable spanner wrench, not shown. With this arrangement rotational torque may thus be applied to the spray tip 48 during assembly to and to effect axial adjustment of this element in the nozzle body 32.

As illustrated, a coil spring 65 is loosely positioned in the fuel chamber 45 whereby one end thereof abuts against the flange 50 of the valve seat element 46 so as to bias it into abutment against the spray tip 48 with the director plate 47 sandwiched therebetween.

To effect filtering of the fuel being supplied to the injector 5 prior to its entry into the fuel chamber 45, there is provided a fuel filter assembly, generally designated 66. The fuel filter assembly 66 is adapted to be suitably secured, as by a suitable press fit, to the nozzle body 32 in position to encircle the radial ports 44.

Referring now to the armature valve member 8, this member, starting in succession from the top with reference to FIG. 1, includes an armature 70, an outward extending radial flange 71, a stud portion 72 and a valve 73. The armature 70 is of tubular configuration and of a predetermined outside diameter whereby it is loosely reciprocable in both the bobbin bore 25 and in the wall 40 of the bobbin 17 and nozzle body 32 respectively.

As shown, the valve 73 is of semi-spherical configuration and of a predetermined radius R, as seen in FIG. 1, whereby it is slidably received and guided by the guide wall 53 of the valve seat element 46 and whereby its spherical lower end defines a seating surface 74 for engagement with the valve seat 55. As illustrated, preferably two or more suitable flats 75 are provided on the outer peripheral side surface of the valve 73, that is about its horizontal center line with reference to FIG. 1, whereby each flat define a passage with the guide wall 63 for the flow of fuel. In the embodiment illustrated in both FIG. 1, and in FIG. 3, four such flats are provided on the valve 73 in circumferentially spaced apart relationship to each other.

Alternately, in lieu of the flats 75 on the valve 73, the valve can be provided with a plurality of radial and downward axial extending grooves 98, as shown in the embodiment of the armature/valve member 8'' shown in FG. 4 which are orientated such as to impart swirl to the fuel metered by the valve. Preferably, two to four such flats 75 or grooves 98 circumferentially equally spaced apart are used to permit substantial uniform fuel flow around the valve.

To further effect axial guiding of the armature/valve member 8 during movement between a lowered position, as shown in FIG. 1, whereat valve 73 engages valve seat 55 and a raised position, there is provided a guide member, in the form of a guide washer 76 that is also positioned in the fuel chamber 45.

The guide washer 76 has a central aperture therethrough defining a straight internal guide wall 77 of a predetermined internal diameter relative to the outside diameter of the armature 70 so as to slidably receive this armature 70 portion of the armature/valve member 8 intermediate its ends. Suitable flats 78 are provided on the outer peripheral surface of the armature 70 at an axial location whereby to define with the guide wall 77 suitable passage for the flow of fuel. In the construction illustrated, three such flats 78 are provided on the armature 70, although only two are shown in FIG. 1. The outside diameter of the guide washer 76 is preselected relative to the internal diameter of the wall 41 of the nozzle body 32 so as to be loosely received therein.

As shown, the guide washer 76, as thus loosely received in wall 41 is held in abutment against the shoulder 43 of the nozzle body 32 by the coil spring 65 which has its opposite end in abutment against the guide washer.

With the arrangement shown, the armature/valve member 8 is guided at one end by the valve 73 slidable in the guide wall 53 of the valve seat element 46 and, intermediate its ends by the armature 70 in the guide wall 77 of guide washer 76 whereby it neither engages the internal wall defined by bore 25 in bobbin 17 nor the wall 40 in the nozzle body 32.

The armature/valve member 8 is normally biased in an axial direction, downward with reference to FIG. 1 to the position shown, so that the valve 73 is in seating engagement with valve seat 55 by means of a coil armature return spring 80 of predetermined force. Armature return spring 80 is positioned to loosely encircle armature 70 with one end thereof in abutment against the flange 71 of the armature/valve member 8 and its opposite end in abutment against the guide washer 76.

When the armature/valve member 8 is in its lowered position as shown in FIG. 1, a working air gap is established between the lower end of the pole piece 20 and the upper end of the armature 70 by axial positioning of the spray tip 48 in the nozzle body 32. However, in order to provide for a minimum fixed working air gap between the lower end of the pole piece 20 and the upper end of the armature 70 when in the raised position, a solenoid stop 81, in the form of a cylindrical plug of, for example, physically hard material, is fixed as by a press fit into the enlarged diameter end portion of a blind bore 82 that extends axially into pole piece 20 from the lower end. In the construction illustrated, the pole piece 20 in addition to the bore 82 is provided with an internal shoulder 82*a* which serves as an abutment stop for one end of the solenoid stop.

The axial extent of the solenoid stop 81 is preselected relative to the axial extent of shoulder 82*a* so that the lower end of the solenoid stop 81 projects downward from the lower end of the pole piece 20 a predetermined distance. The lower end face of the solenoid stop 81 thus is operative to limit upward movement of armature 70 toward the lower working face of the pole piece 20 so as to establish a minimum fixed working air gap between the opposed working surfaces of the pole piece and armature.

The upper surface of the armature 70, in the central area thereof which would abut against the solenoid stop 81 is either locally hardened or, preferably, a hard metal contact button, not shown, is inserted, as by a press fit, into a suitable blind bore, not shown, provided for this purpose in the free end of the armature 70.

A feature of the subject invention is the method of making the solenoid assembly 6, previously described hereinabove. To effect assembly and fabrication of the solenoid assembly 6, the portion 22 of the pole piece 20 is first inserted into the open end of the solenoid housing 10 and then is positioned so as to extend through the aperture 15 in the flange 12 of the solenoid housing 10.

The upper end of the portion 22 of the pole piece 20 is next suitably crimped or swaged radially outward to form the retention flange 24 used to secure the flange 12 of the solenoid housing 10 into fixed abutment against the shoulder 23 of the pole piece 20 with the lower portion 21 of the pole piece 20 being supported centrally within and encircled by the circular body 11 of solenoid housing 10.

The bobbin 17, with the solenoid coil 18 which it supports, is then inserted and positioned in the solenoid housing 10 so as to be supported by the lower portion 21 of the pole piece 20 extending into the bore 25 of bobbin 17. During this positioning of the bobbin 17, the terminal leads 20 are aligned so as to extend centrally through the respective pair of apertures 16 in the flange 12 of the solenoid housing 10. This alignment of the terminal leads 20 in the apertures 16 is established, in effect, by alignment of the bosses 28 on the bobbin 17 into the respective apertures 16.

Thereafter, as shown in FIG. 2, this assembly of solenoid housing 10, pole piece 20, bobbin 17 and solenoid coil 18 with its terminal leads 29 is positioned in a suitable multi-piece mold for the injection molding in place of the encapsulant member 30.

In the construction schematically illustrated in FIG. 2, a three piece mold is used for the in-place molding of the encapsulant member 30. With reference to the structure shown in this Figure, the mold includes an upper mold 100, a lower mold 101 which may be a fixed mold element and a movable mandrel 102. As is well known, a suitable retainer means, not shown, would also be used for releasably securing the upper mold 100 and lower mold 101 together during the molding operation. In addition, a suitable means would be provided to effect reciprocable movement of the mandrel 102. These means are not shown or described herein, since such means are well known in the molding art and since the details thereof are not deemed necessary for an understanding of the subject invention.

As shown, the upper mold 100 and lower mold 101 when assembled together define a die cavity 103 of a size and shape conforming to the desired external size and shape of the outer shell portion 30*c* and studs 30*d* of the encapsulant member 30. The upper mold 100 is also provided with two vertical through apertures 104 of a size to slidably receive the terminal leads 29 in the manner shown whereby the studs 30*d* will only enclose a predetermined axial portion of these terminal leads. One or more sprue passages 120 is provided in either the upper mold 100, or lower mold 101, as shown, for the injection of the encapsulant material into the die cavity 103.

To support and effect proper positioning of the solenoid housing 10 within the die cavity 103, the lower mold 101 which is of cup-shaped configuration, is provided with a stepped bore extending from the base thereof to define an internal lower wall 105, an internal intermediate wall 106 and an internal upper wall 107 all of circular configuration and of increasing internal diameters in the order named. Walls 105 and 106 are interconnected by a flat wall 108. Walls 106 and 107 are interconnected by a shoulder 109. The intermediate wall 106 is of a preselected diameter and axial extent whereby to slidably receive the lower portion 11*b* of the solenoid housing 10 so that its lower free end surface abuts against the wall 108.

The internal diameter of the lower wall 105, which is of a much smaller internal diameter than wall 106, is preselected so as to slidably receive and axially guide the actuator rod 110 of mandrel 102. In the construction shown, mandrel 102 also includes a stepped core portion providing a housing guide core 111, a bobbin guide core 112 and a pole piece guide core 114.

Preferably, as shown in FIG. 2, the housing guide core 111 includes a lower housing guide portion 111*a* of an external diameter corresponding to the internal diameter of the lower portion 11*b* of the solenoid housing whereby it will be slidably received therein, an upper guide portion 11*b* of predetermined axial extent and of an external diameter so as to be slidably received in the upper portion 11*b* of the housing 10, and a flat surface 111*c* interconnecting portions 111*a* and 111*b*.

The bobbin guide core 112 is of an external diameter and of an axial extent so as to be slidably received in the bore 25 of bobbin 17 while the pole piece guide core 114 is of an external diameter so as to be slidably received in the bore 82 of the pole piece 20. Preferably, as shown, the free end of the pole piece guide core 114 is tapered, as desired, to facilitate its alignment and entry into the bore of the pole piece and, this core 114 should be of a suitable axial extent relative to the cores 111 and 112 so that it will first enter the bore 83 in the pole piece 20 so as to effect alignment of the bobbin guide core 112 and housing guide core 111, with the bobbin 17 and solenoid housing 10, respectively, before inter-engagement of these elements.

Also, as shown, the axial extent of the housing guide core 111 is made suitably less than the axial extent of the lower portion 11*b* of the solenoid housing 10 so as to allow seating engagement of the lower rim end of this housing within the lower mold 101, as previously described.

With this arrangement, the mandrel 102 can be moved by the actuator rod 110 between a lowered position at which the housing guide core 111 abuts against the internal flat wall 108 of the lower mold 101 and a raised position, the position shown in FIG. 2, at which it centers and supports the solenoid housing 10, bobbin 17, and pole piece 20 within the die cavity of the mold assembly.

Although any suitable means can be used to control or limit the raised position of the mandrel 102, as described, in the construction illustrated, a stop collar 115 is adjustably secured to the actuator rod 110 by means of a set screw 116 threadedly received in the stop collar for abutment against the actuator rod whereby the stop collar 115 is adapted to abut against the lower mold 101 to limit upward travel of the mandrel 102.

The assembly of solenoid housing 10, bobbin 17 and pole piece 20, and the elements associated therewith are thus adapted to be positioned and supported within the die cavity 103 and in spaced relation to the internal walls of the molds 100 and 101 defining the die cavity whereby the encapsulant member 30 can be molded in place.

As is well known, suitable punch pins, not shown, may be used with the molds 100 and 101 to effect removal of the solenoid assembly 6 from these molds after the molding process has been completed. In addition, a suitable draft or taper can be provided, as desired, on the walls defining the die cavity 103 so that the solenoid assembly can be withdrawn therefrom.

It should now be apparent that with the assembly shown, any mold flash that may occur, can be located at positions where it need not be removed. That is, such mold flash will be at locations where it will not interfere with either the operation or installation, as in an injector receiving socket, not shown, for the electromagnetic fuel injector 5.

Although a three piece mold has been illustrated and described with reference to the in-place molding of the encapsulant member 30 of the injector of FIG. 1, it will be apparent to those skilled in the art that, depending on the desired outside configuration of the encapsulant member other multi-piece mold and mandrel arrangement can be used and that one or more of the molds may be of the split-ring collar type so as to accommodate for the molding of the encapsulant members of the injectors shown, for example, in FIGS. 3 and 4.

Figure 3:
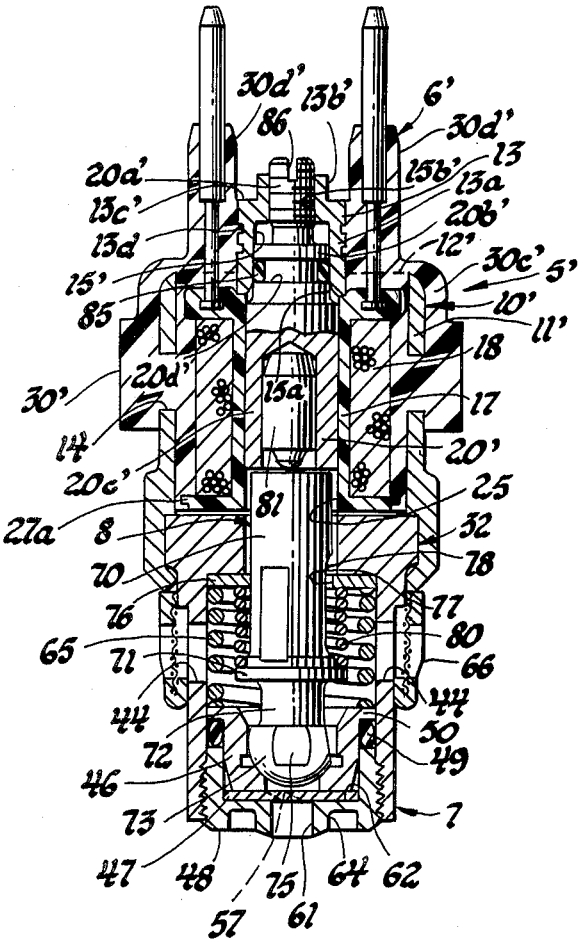
FIG. 3 is a longitudinal cross-sectional view of an alternate embodiment of an electromagnetic fuel injector having an alternate embodiment solenoid assembly in accordance with the invention incorporated therein, the armature stop and the armature/valve member of the injector being shown in elevation.

An alternate embodiment of an electromagnetic fuel injector, generally designated 5', with an alternate embodiment of the solenoid assembly 6' in accordance with the invention is shown in FIG. 3, wherein similar parts are designated by similar numerals but with the addition of a prime (') after the reference numerals where appropriate.

In this alternate embodiment of the solenoid assembly 6', the flange 12' of the solenoid housing 10' is provided with an upstanding boss 13' of stepped exterior configuration so as to provide a lower boss portion **13*a'*, an upper boss portion 13*b'* of reduced external diameter as compared to that of the lower boss portion 13*a'* and an external shoulder 13*c'* interconnecting these two boss portions. Preferably, as shown, the lower boss portion 13*a'* is provided with one or more annular grooves 13*d'* for interlocking engagement with the encapsulant member 30'**.

Flange 12' and the boss 13' are provided with a central stepped aperture 15' extending therethrough to define an internal circular lower guide wall **15*a'* and an upper internally threaded wall 15*b'* of an internal diameter less than that of the guide wall 15*a'***.

In this embodiment of FIG. 3, the pole piece 20' is of stepped external configuration to provide an upper externally threaded screw portion **20*a'* adapted to be threadingly engaged in thread wall 15*b'* of the solenoid housing, an intermediate portion 20*b'* of an external diameter so as to be slidably received in the guide wall 15*a'* of the housing and a lower portion 20*c'* of an external diameter to be received in the bore wall 25 of the bobbin 17. In addition the outer peripheral surface of the intermediate portion 20*b'* is provided with an annular groove 20*d'* to receive a suitable ring seal, such as an O-ring 85**.

The pole piece 20' at its upper free end is provided with a suitable tool engaging recess or groove, such as screwdriver slot 86, whereby rotative torque can be applied to the pole piece 20' to effect the desired axial positioning thereof during assembly and testing of the injector.

In the embodiment of FIG. 3, the outer shell **30*c'* and the stud 30*d'* portions of the encapsulant member 30' on their sides adjacent to the boss 13' of the solenoid housing 10 extend upward about the boss 13' to its external shoulder 13*c'***.

The remaining structure of the electromagnetic fuel injector 5' structure of FIG. 3 is similar to that of FIG. 1 and, accordingly, it is not deemed necessary to further describe these other structural elements in detail herein.

Figure 4:
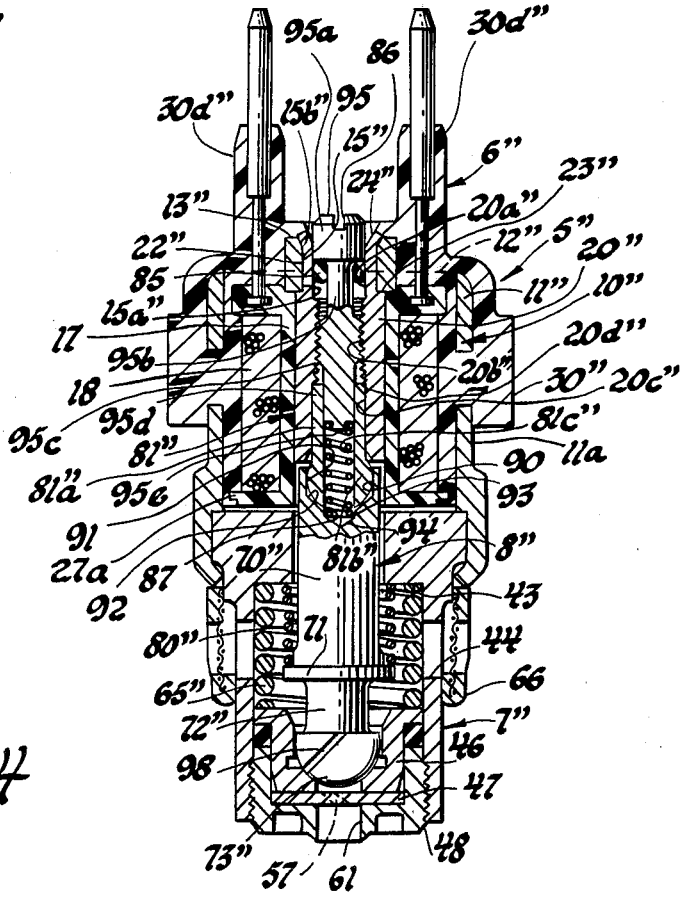
FIG. 4 is a longitudinal cross-sectional view of another alternate embodiment of an electromagnetic fuel injector having another alternate embodiment solenoid assembly in accordance with the invention incorporated therein, the armature/valve member of the injector being shown partly in elevation; and, FIG. 5 is a top view of the bobbin and coil assembly, per se, of a solenoid assembly of the type shown in FIGS. 1 to 4.

A still further alternate embodiment of an electromagnetic fuel injector, generally designated 5'', with another alternate embodiment solenoid assembly 6'' in accordance with the invention is shown in FIG. 4 wherein similar parts are designated by similar numerals but with the addition of double prime (") after the reference numerals where appropriate.

In the construction of the solenoid assembly 6'' shown in FIG. 4, the flange 12'' of the solenoid housing 10'' is provided with an upstanding boss 13'' with an aperture 15'' extending therethrough. The aperture 15'' defines a lower straight bore wall **15*a''* and an upper beveled internal rim 15*b''***.

The reduced diameter upper portion 22'' of an associate pole piece 20'' extends through the bore wall **15*a''* and has its upper end crimped or swaged over against the rim 15*b''* whereby to define a retention flange 24'' preventing axial movement of the pole piece in one direction. Axial movement of the pole piece in the opposite direction is fixed by abutment of the shoulder 23'' thereof abutting against the lower rim edge of the boss 13''**.

The pole piece 20'' in the embodiment of FIG. 4 is provided with a stepped bore therethrough which, starting at the top with reference to this Figure, defines an internal circular upper bore wall **20*a''*, an intermediate internally threaded wall 20*b''* and a lower straight bore wall 20*c''*, with the intermediate threaded wall 20*b''* being of reduced internal diameter relative to the internal diameters of walls 20*a''* and 20*c''*. The walls 20*b''* and 20*c''* are interconnected by a shoulder 20*d''***.

The armature stop 81'' associated with the pole piece 20'' is provided with an upper straight wall portion **81*a''* of a size so as to be secured as by a press fit into bore wall 20*c''* in abutment at its upper end against shoulder 20*d''* and a lower ball guide 81*b''* that is of semi-spherical configuration and of predetermined external diameter. In addition, a bore 81*c''* extends axially through the armature stop 81''**.

The axial extent of the armature stop 81'' as mounted in the pole piece 20'' is such so that the ball guide **81*b*** extends below the lower working face of the pole piece 20″ a predetermined axial distance.

Referring now to the nozzle assembly 7″ shown in the FIG. 4, in this embodiment, the associate armature/-valve member 8″ is guided for axial movement at its lower valve 73″ end in valve seat element 46 in a manner similar to that described hereinabove with reference to the nozzle assembly 7. However, in the embodiment of FIG. 4, the armature/valve member 8″ is guided at its opposite end by means of the armature stop 81″.

For this purpose the armature 70″ of the armature/-valve member 8″, which is of circular cross-section along its entire axial extent, is provided with a ball socket 90 at its upper, free end. Socket 90 is defined by a circular straight internal guide wall 91 of an internal diameter so as to slidably receive the ball guide 81*b*″ of armature stop 81″, a radial inward extending, conical guide stop seat 92 and a spring guide bore wall 93 terminating at its lower end in a spring abutment shoulder 94.

The axial depth of the guide stop seat 92 from the upper working face of the armature 70″ relative to the axial extent of the ball guide 81*b*″ from the opposed working face of the pole piece 20″ is predetermined so that when the armature/valve member 8″ is in its lowered position as shown in FIG. 4 a predetermined axial gap will exist between the ball guide 81*b*″ and the guide stop seat 92. However, as the armature/valve member 8″, upon energization of the solenoid coil 18, moves upward toward the pole piece 20″ its upward movement will be limited by engagement of the guide stop seat 92 with the ball guide 81*b*″ so as to establish a minimum fixed working air gap between the opposed working surfaces of the pole piece and armature.

This arrangement while guiding the upper end of the armature during reciprocating movement thereof allows the armature/valve member 8″ to operate with some level of centerline skewness with respect to the pole piece 20″ centerline without affecting the stroke parameter or hydraulic adherence (stiction) at the ball guide 81*b*″ and guide stop seat 92.

In this embodiment of the nozzle assembly 7″, the coil spring 65″, which is used to bias the associate valve seat element 46 against the spray tip 48 with the director plate 47 sandwiched therebetween, has its upper end, with reference to this Figure, in abutment against the shoulder 43 of the associate nozzle body 32. In a similar manner the armature return spring 80″ also abuts at its upper end against this shoulder 43, the spring 80″ in this embodiment being part of an armature spring biasing means that also includes a trim spring 87 positioned so that its force can be adjusted, as desired, through an externally accessible adjusting means.

For this purpose, the trim spring 87 is loosely received in the cavity defined by bore wall 81*c*″ and in spring guide bore wall 93 in the armature stop 81″ and armature 70″, respectively, whereby the lower end of the trim spring 87 abuts against the shoulder 94 of the armature 70″. The trim spring 87 at its opposite end is positioned to abut against an externally accessible adjustment screw 95.

The adjustment screw 95 in the construction illustrated in FIG. 4, includes a head 95*a* of a diameter to be slidably received in bore wall 20*a*″ of the pole piece 20″, with a depending shank extending therefrom which includes a reduced diameter shank portion 95*b*, an externally threaded screw portion 95*c* threadingly engaged with internally threaded wall 20*b*″ and a lower abutment portion 95*d* of a diameter to be slidably received by the bore wall 81*c*″ of the armature stop 81″. As shown the abutment portion 95*d* terminates at an abutment surface and centering pin 95*e* for the upper end of the trim spring 87.

The head 95*a* of the adjustment screw 95 is provided with a suitable internal drive recess, for example, a screwdriver slot 86, whereby this screw 95 can be rotated, as desired, to effect axial displacement thereof in either an up or down direction as desired, with reference to FIG. 4, whereby the force of the trim spring 87 can be varied, as desired.

The combined forces of springs 80″ and 87 are preselected so as to obtain the desired biasing force against the armature/valve member 8″ whereby to obtain the desired dynamic response thereof in its movement toward and away from the working face of the pole piece 20″. To facilitate adjustment of this total biasing force, the force of spring 87 is preselected so that its force preferably constitutes about 50 percent or more of the total biasing force acting against the armature/valve member 8″.

As illustrated in FIG. 4, an O-ring seal 85 is positioned to encircle the shank portion 95*b* of the abutment screw 95 to effect a fluid tight seal between it on the bore wall 20*a*″ of the pole piece 20″.

In molding in place either the encapsulant member 30″ of the FIG. 3 embodiment or the encapsulant member 30″ of the FIG. 4 embodiment, it will be apparent that the die cavity 103 configuration in the upper mold 100 portion will be made of a corresponding configuration, as necessary, in a manner which will be apparent to those skilled in the molding art.

The embodiments of the invention in which an exclusive property or privilege is claimed are defined as follows:

1. A solenoid assembly for use in an electromagnetic fuel injector for gasoline engines, said solenoid assembly including a sheet metal housing means having a tubular outer housing portion with radial openings therethrough and a perforated flange portion extending radially inward from one end of said housing portion, said flange portion having a central aperture therein; a cylindrical pole piece having one end received in said aperture and fixed to said flange portion with the other end of said pole piece located concentrically within said housing portion and extending toward the opposite open end of said housing portion; a solenoid coil means including a bobbin and a wire coil encircling said pole piece within said housing portion with portions of said solenoid coil means radially spaced from said housing portion; annularly grooved electrical lead means operatively connected at one end to said solenoid coil means with the opposite ends thereof extending outward of said housing means through said perforated flange portion; and, a plastic envelope means encircling said solenoid coil means to form a fluid tight seal between said solenoid coil means and the interior of said housing means and to fully envelop said flange portion and said one end of said pole piece and, to envelop at least an outer circumferential portion of said outer housing portion next adjacent to said flange portion and the grooved portion of each of said lead means.

2. A solenoid assembly for use in an electromagnetic fuel injector for gasoline engines, said solenoid assembly including a sheet metal housing means having a tubular outer housing portion with circumferentially spaced apart radial openings therethrough and a flange portion extending radially inward from one end of said housing portion, said flange portion having at least two circumferentially spaced apart lead apertures and a central aperture therein; a cylindrical pole piece having one end received in said aperture and fixed to said flange portion with the other end of said pole piece located concentrically within said housing portion and extending toward the opposite end of said housing portion; a solenoid coil means including a bobbin and a solenoid coil encircling said pole piece within said housing portion, with portions of said solenoid coil means radially spaced from said housing portion; electrical lead means operatively connected at one end to said solenoid coil means with the opposite ends thereof extending outward of said housing means through said perforated flange portion; said lead means having annular grooves thereon located outboard of said flange portion; and, an encapsulating means encircling said solenoid coil means and portion of said bobbin to form a fluid tight seal between said solenoid coil means and said bobbin and the interior of said housing means and to envelop at least an outer circumferential portion of said housing means, a portion of said lead means to at least a position outboard of said grooves and, to envelop said flange portion and said one end of said pole piece.

* * * * *